US006963279B1

(12) United States Patent
Martinelli et al.

(10) Patent No.: US 6,963,279 B1
(45) Date of Patent: Nov. 8, 2005

(54) SYSTEM AND METHOD FOR TRANSMITTING SURVEILLANCE SIGNALS FROM MULTIPLE UNITS TO A NUMBER OF POINTS

(75) Inventors: Gary Martinelli, Bridgeport, CT (US); Moti Bordoley, Wilton, CT (US)

(73) Assignee: International Microwave Corporation, Norwalk, CT (US)

( * ) Notice: Subject to any disclaimer, the term of this patent is extended or adjusted under 35 U.S.C. 154(b) by 97 days.

(21) Appl. No.: 10/454,385

(22) Filed: Jun. 3, 2003

(51) Int. Cl.[7] ..... G08B 1/08
(52) U.S. Cl. ..... 340/539.22; 340/539.17; 340/539.18; 340/539.26
(58) Field of Search ..... 340/539.22, 539.17, 340/539.18, 539.19, 539.26

(56) References Cited

U.S. PATENT DOCUMENTS 3,839,707 A * 10/1974 Woodward et al. ..... 714/4
4,332,980 A * 6/1982 Reynolds et al. ..... 370/259
5,544,661 A * 8/1996 Davis et al. ..... 600/513
6,246,320 B1 * 6/2001 Monroe ..... 340/506

* cited by examiner

*Primary Examiner*—Thomas J. Mullen, Jr.
*Assistant Examiner*—Son Tang
(74) *Attorney, Agent, or Firm*—Thelen Reid & Priest LLP

(57) ABSTRACT

A communication device for relaying data associated with a surveillance system is envisioned. The communication device has a plurality of inputs for communicatively coupling the communication device with a plurality of surveillance sensors, each of the plurality of inputs associated with one of a plurality of surveillance sensor data streams. Also present is a wireless communication system for inputting and outputting a data stream, the data stream being directed to another remote wireless communication device. This data stream contains the surveillance sensor data. The communication device also has a communication junction communicatively coupled to the wireless communication device and the plurality of inputs. The communication junction coalesces the data from the plurality of inputs into the data stream. The communication junction also retrieves individual surveillance sensor data from the data stream, and directs the particular surveillance sensor data stream to a particular one of the plurality of inputs.

9 Claims, 4 Drawing Sheets

SYSTEM AND METHOD FOR TRANSMITTING SURVEILLANCE SIGNALS FROM MULTIPLE UNITS TO A NUMBER OF POINTS

FIELD OF THE INVENTION

The present invention relates to a communication system for surveillance posts. More particularly, the present invention is related to a data transfer system that serves multiple surveillance posts each containing multiple surveillance devices and distributes the data among a plurality of network points.

BACKGROUND

Many surveillance stations employ multiple surveillance technologies. These technologies include passive and active detection systems, including acoustic, electric, image, image differential, seismic, thermal, to name a few. Many surveillance stations are built in places not readily accessible to human interference. For example, among borders containing relatively light population and desolate environmental conditions, electronic data gathering is crucial for continued surveillance activities.

In some situations, the data collection sensors are placed in a geographic area. These data collection sensors can feed information to a centralized transmission station, from which the data is relayed to an operations center. In the operations center, the data is observed and acted upon.

In many situations it is hard to reset alarm values for sensor readings, or communicate with the data gathering devices. Communication may be hard since many different sensors are involved, and the communication legs to the sensors may be haphazard, at best.

SUMMARY

Aspects of the invention are directed to a communication device for relaying data associated with a surveillance system. The communication device has a plurality of inputs that communicatively couple the communication device with a plurality of surveillance sensors. Each of the plurality of inputs is associated with one of a plurality of surveillance sensor data streams.

Also present is a wireless communication system. This inputs and outputs a data stream from or to the communication device, respectively. The data stream is directed to another remotely located wireless communication device. The data stream has the surveillance sensor data contained within it.

A communication junction is communicatively coupled to the wireless communication device and the plurality of inputs. This coalesces the data from the plurality of inputs into the data stream. The communication junction operates to retrieve the individual surveillance sensor data stream from the data stream, and directs the particular surveillance sensor data stream to the particular inputs.

In one aspect, the communication junction has a multiplexer. The multiplexer is communicatively coupled to the plurality of inputs, and multiplexes the plurality of surveillance sensor data streams into the data stream. The multiplexer can employ a time domain multiplexing algorithm.

The communication junction also has a demultiplexer. This demultiplexes the data stream into the plurality of surveillance sensor data streams.

In an exemplary aspect, the wireless communication system and the communication junction are coupled in a bi-directional manner. This can be accomplished through usage of dual cables. The communication device can deliver data between the communication junction and the wireless communication on a subcarrier frequency of a frequency associated with the output of the wireless communication device to the remote wireless communication device.

The received data stream can contain control messages for a particular surveillance sensor. In this manner, the sensor operation may be controlled from a remote source.

In one case, one of the inputs is associated with an acoustic message. Thus, radio communications can be delivered to the other remote surveillance units.

Aspects are also drawn to a device for monitoring incoming data associated with a plurality of remotely located sensors and outputting outgoing data associated with controlling the operation of the plurality of sensors associated with a surveillance post. This device has a wireless communication system for communicating the incoming and outgoing data. The device also has a communication junction that is communicatively coupled to the wireless communication device. This communication junction is operable to separate data associated with each of the sensors from the other sensors.

The monitoring device employs a user interface that is communicatively coupled to the wireless communication device. This monitoring device displays a representation of the incoming data associated with each of the sensors.

The monitoring device can employ a demultiplexer. This demultiplexes the incoming data into the plurality of surveillance sensor data streams.

An outgoing data stream can be made up of control messages. These control messages can be targeted for a particular surveillance sensor, a particular surveillance station, or a particular grouping of surveillance sensors by type.

The monitoring device can also have a user interface. The control messages can be generated through the interaction of an operator through the interface. The control messages can set operational aspects of the sensor or sensors, such as changing alarm levels, determining on/off cycles, or determining triggers based on data.

A surveillance system for detecting objects is also imagined. The surveillance system has a plurality of surveillance posts. Each of the surveillance posts has a plurality of sensors.

Each surveillance post also has a wireless communication system working in conjunction with a communication junction. This allows for inputting and outputting a data stream.

A surveillance system working in conjunction with the monitoring aspects is contemplated. The surveillance system is augmented with the addition of at least one monitoring unit. The monitoring unit has a wireless communication system for communicating the incoming and outgoing data with the surveillance posts. A communication junction, communicatively coupled to the wireless communication device at the monitoring unit, separates the data associated with each of the plurality of sensors from the others. The monitoring system also employs a user interface that is communicatively coupled to the wireless communication device. The user interface displays a representation of the incoming data associated with each of the plurality of sensors at each of the plurality of surveillance posts.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention are described herein in the context of a System And Method for Monitoring Surveillance Signals from Multiple Units to A Number of Points. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with the present invention, the components, process steps, and/or data structures may be implemented using various types of digital systems, including hardware, software, or any combination thereof. In addition, those of ordinary skill in the art will recognize that devices of a less general-purpose nature may also be used without departing from the scope and spirit of the inventive concepts disclosed herein.

Figure 1:
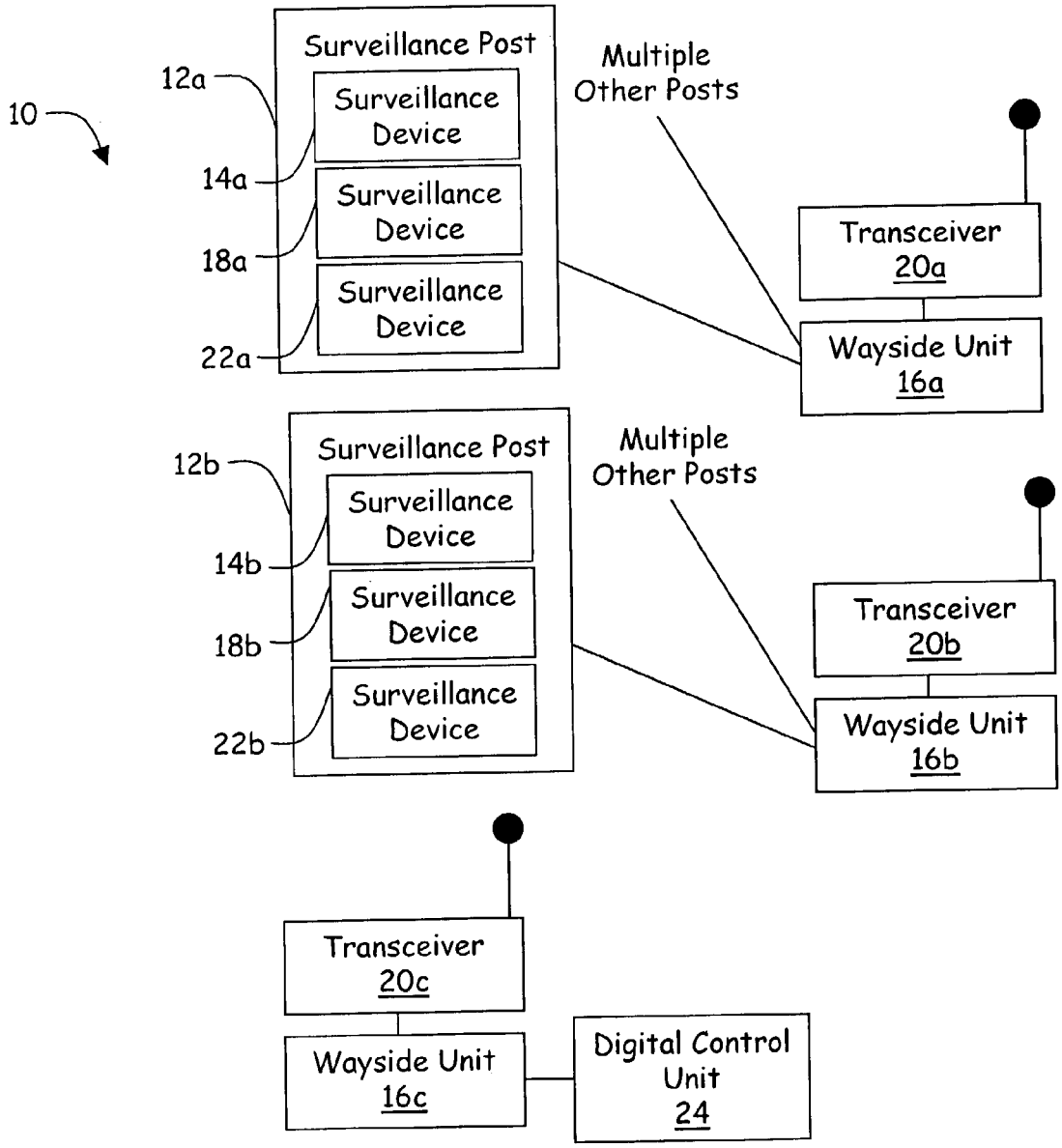
FIG. 1 is a network diagram of an implementation of a communication scheme among remotely located surveillance posts.

FIG. 1 is a network diagram of an implementation of a communication scheme among remotely located surveillance posts, according to the invention. A surveillance network 10 contains a plurality of wayside units, denoted by the units 16*a* through 16*c*. Each wayside unit 16 is communicatively coupled to a plurality of surveillance posts, denoted as 12 in FIG. 1. Thus, in the case of the wayside unit 16*a*, the surveillance post 12*a* is communicatively coupled to it. Likewise, another surveillance net is depicted, one having the wayside unit 16*b* coupled to the surveillance posts including the surveillance post 12*b*.

Of course, the surveillance posts may be further delineated as having one or more surveillance sensors. Thus, the surveillance post 12*a* contains the surveillance sensors 14*a*, 18*a*, and 22*a*, and the surveillance post 12*b* contains the surveillance sensors 14*b*, 18*b*, and 22*b*. As noted before, these surveillance sensors may take many forms, such as acoustic, electric, image, image differential, seismic, thermal, or motion sensing apparatuses, to name a few. Of course, any type of sensor may be implemented.

The surveillance posts 12 are communicatively coupled to the associated wayside unit 16. This coupling may take the form of a hard-wired coupling, or through the use of wireless technology. The data or other communications generated by the various sensors are relayed to the wayside unit 16 from each of the surveillance posts 12 associated with the particular wayside unit 16. As such, the data generated, routine reports, diagnostics, or control communications are relayed between the associated wayside unit 16 and the particular surveillance post 12. Further, particular messaging may be implemented on a sensor based communication schedule as well.

A wayside unit 16*c* is also depicted. This wayside unit 16*c* is coupled to a digital control unit 24. The digital control unit 24 is operable to monitor the various surveillance posts and/or surveillance sensors associated with any of the other wayside units. The wayside unit 16*c* may also have one or more surveillance posts communicatively coupled to it, as well as the digital control unit.

The wayside unit 16 is coupled to a radio transceiver 20. This radio transceiver 20 allows communication by and between the various wayside units. Thus, communication links may be maintained between the wayside unit 16*a* and the wayside unit 16*b*, and the wayside unit 16*b* and the wayside unit 16*c*. These communications may be linked in a serial basis, such as having one wayside unit speak to two other wayside units, in a hub and spoke fashion, or in a broadcast fashion. Of course, the network topology may require various combinations, and this specification should be read to contemplate each of the aforementioned methods, as well as any combination thereof.

Thus, a communication web may be created between the various wayside units in a surveillance network. Further, communications at the wayside unit level may be directed to specific surveillance posts, or specific sensors. Further, communication may be directed on a class basis, such as talking to all the sensors having certain properties in a particular geographic area.

In an example, a centralized control may determine that thermal sensoring information is best collected at night, when the ambient temperature is below a certain point, or when the weather is one of rain. Thus, a command may be broadcast to the various wayside units through the associated radio transceivers to implement this. Additionally, assume that at some control station, a signal is sent at dusk and broadcast to the entire surveillance net. In this manner, the particular surveillance equipment may be toggled on an appropriate basis throughout the surveillance net 10.

Also, various alarm levels may be set in a similar manner. Assume that the surveillance sensor 14*a* originally is set to signal an alarm at a first threshold. The communication between the units allows the parameter to be set to any other threshold. Further, the threshold may be set on an individual, group, classification, or global scale.

Each of the surveillance posts 12 may operate under certain parameters. Assume that the surveillance post 12*a* contains only a thermal imager, and as such, operates optimally at night. In this case, the post may be directed to an active state based upon environmental conditions. Or, each internal sensing device may operate under the same or related parameters. Or, a trigger may be defined where the alarm in one sensor triggers an operation in another.

In one implementation, a radio transceiver 20*c* is communicatively coupled to a wayside unit 16*c*. A digital control unit 24 is communicatively coupled to the wayside unit 16*d*. In this manner, the state of any wayside unit, surveillance post, or surveillance sensor may be monitored and controlled. Also, the computing device may be operable to communicatively couple at any of the other wayside units, thus providing the ability to monitor and/or control the surveillance network 10 from any node on the surveillance network.

Figure 2:
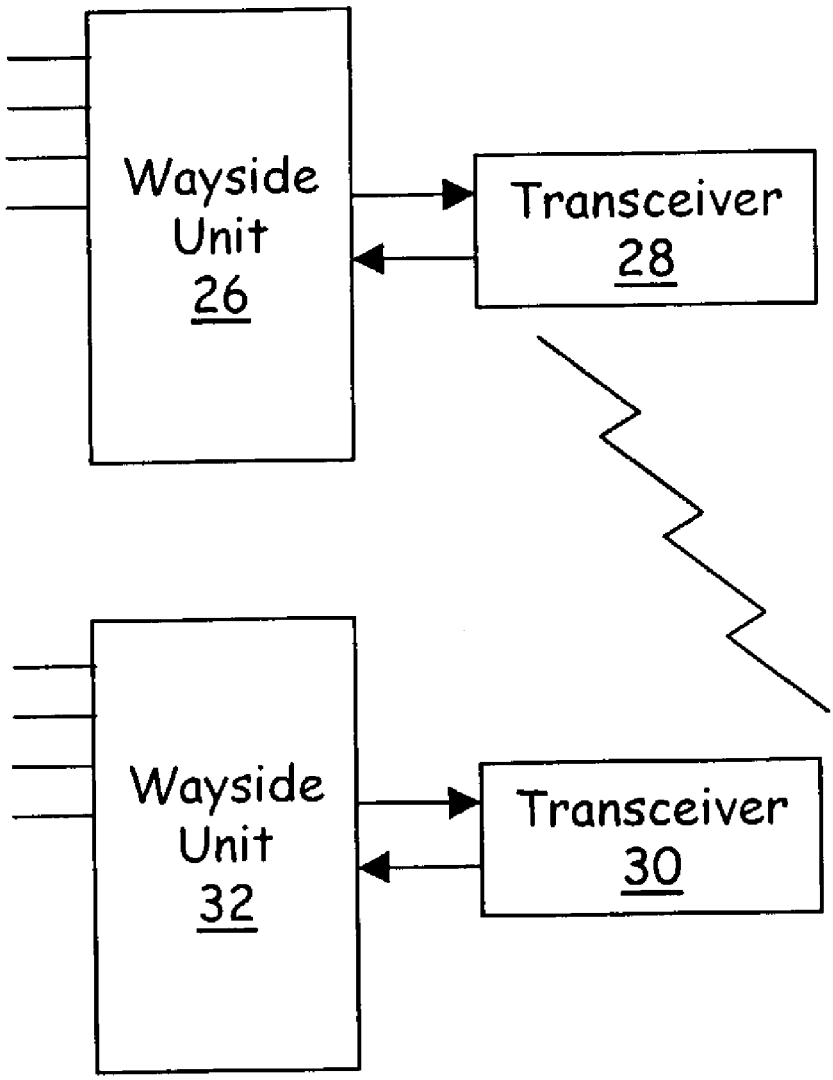
FIG. 2 is an operational schematic view showing the coupling of an exemplary transceiver/wayside unit pair of FIG. 1.

FIG. 2 is a detailed schematic view showing the coupling of an exemplary transceiver/wayside unit pair of FIG. 1. The diagram also shows the coupling of the transceiver/wayside pairs with one another and with another transceiver/wayside unit pair in the surveillance net. First, a wayside unit 26 is directly coupled to an analog radio 28. Correspondingly, a wayside unit 32 is directly coupled to an analog radio 30, and the radios 28 and 30 are in communication with one another.

In one embodiment, the wayside unit 26 is coupled to the transceiver 28 through two coaxial cables. The wayside unit 26 is coupled to maintain multiple separate signals, transmitted and received, over the two coaxial cables. In this manner, the signals generated by the attached multiple surveillance posts are multiplexed for analog transmission over the transceiver 28. In this manner, the data associated with the attached sensors may be broadcast from the analog radio 28 to other analog radios, such as the radio 30. The wayside unit 26 output can be a subcarrier, and as such the signal can be used directly the radio 30.

Conversely, incoming messages are received by the radio 28 and routed to the wayside unit 26. The signals are demultiplexed and routed to the appropriate coupled surveillance post or surveillance sensor, as necessary. In the case where the wayside unit outputs a subcarrier to the radio, the subcarrier frequency is high enough to not interfere with the main radio inputs and/or outputs.

In one embodiment, all the inputs are digitized and combined into one output signal. Of course, many different methods may be used to send such signals, and should be contemplated by this disclosure.

In this manner, the wayside units operate in a bi-directional (full duplex) manner. Of course, other duplex modes may be utilized and should be construed to be included in this description.

Data can be transmitted between the various surveillance posts. This may be a preset timetable, on an as-needed basis, or on a dynamically variable timetable. Or, various combinations may be used with the surveillance posts, the surveillance sensors.

The wayside unit operates as a junction between the wireless communication between the radio transceivers and the sensor connections. Data flowing from the transceiver to the sensors is directed to the proper sensor by the wayside unit. The wayside unit also coalesces the data from the sensors to be broadcast by the radio transceiver.

In one exemplary embodiment, the wayside unit uses time division multiplexing (TDM) to combine the multiple inputs into a single subcarrier output. The multiple inputs are digitized before being multiplexed. In an exemplary embodiment, the subcarrier frequency operates at a frequency of 6.5 MHz. Of course, numerous other frequencies are envisioned. In conjunction with the TDM, a frame is generated for transmission. In one embodiment, framing bits are combined with the samples of the individual channels. The far-end wayside unit searches and finds the framing bits upon reception. These framing bits are used as markers to determine how to deconstruct the signal back into the individual channels.

In one exemplary embodiment, the wayside unit allows each input to be user configurable. The lines may be used for various sensors.

Additionally, an input line may be reserved to command functions and management purposes. Another line may be used to allow for the attachment of a headset, thus allowing operators at various nodes to remain in communication with one another.

Figure 3:
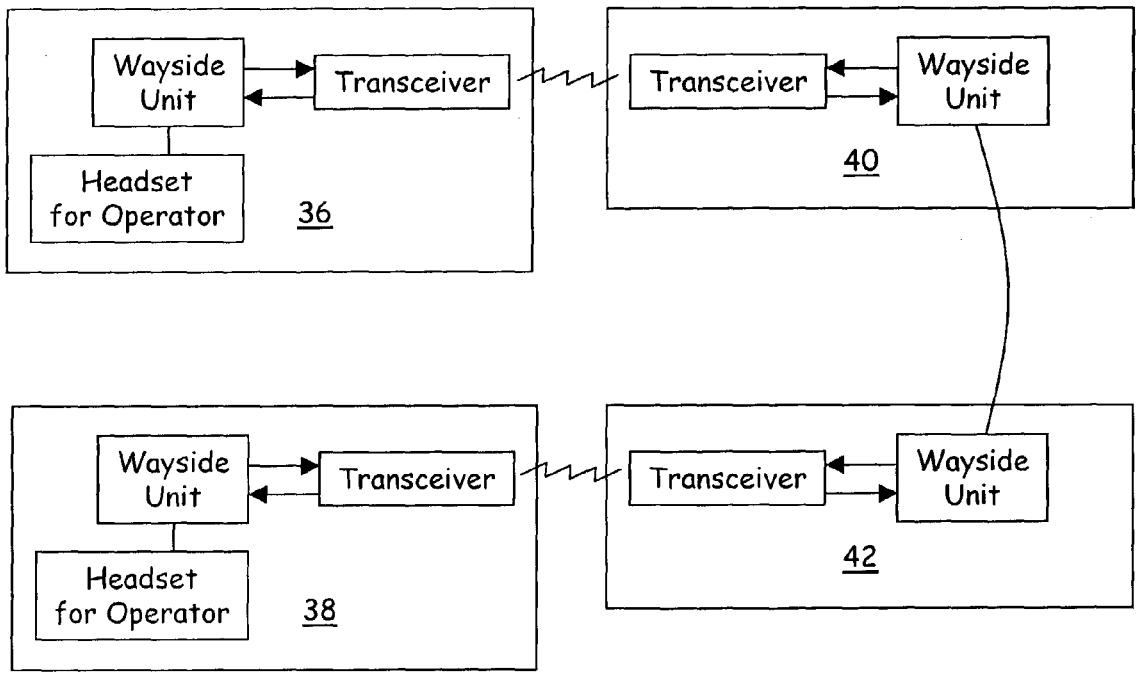
FIG. 3 is schematic representation of allowing combinations of analog communications associated with the wayside unit/transceiver pairs.

FIG. 3 is schematic representation of allowing combinations of analog communications associated with the wayside unit/transceiver pairs. A first user is associated with a wayside unit/radio pair 36. A second user is associated with a wayside unit/radio pair 38. The wayside unit/radio pair 36 communicates to a wayside unit/radio pair 40, and the wayside unit/radio pair 38 communicates to a wayside unit/radio pair 42. A third user is associated with the wayside unit/radio pair 42 and the wayside unit/radio pair 40.

The wayside unit/radio pair 42 and the wayside unit/radio pair 40 are communicatively coupled. This may be accomplished by such means as a bridging cable. In this manner, each of the three users may communicate amongst themselves.

Figure 4:
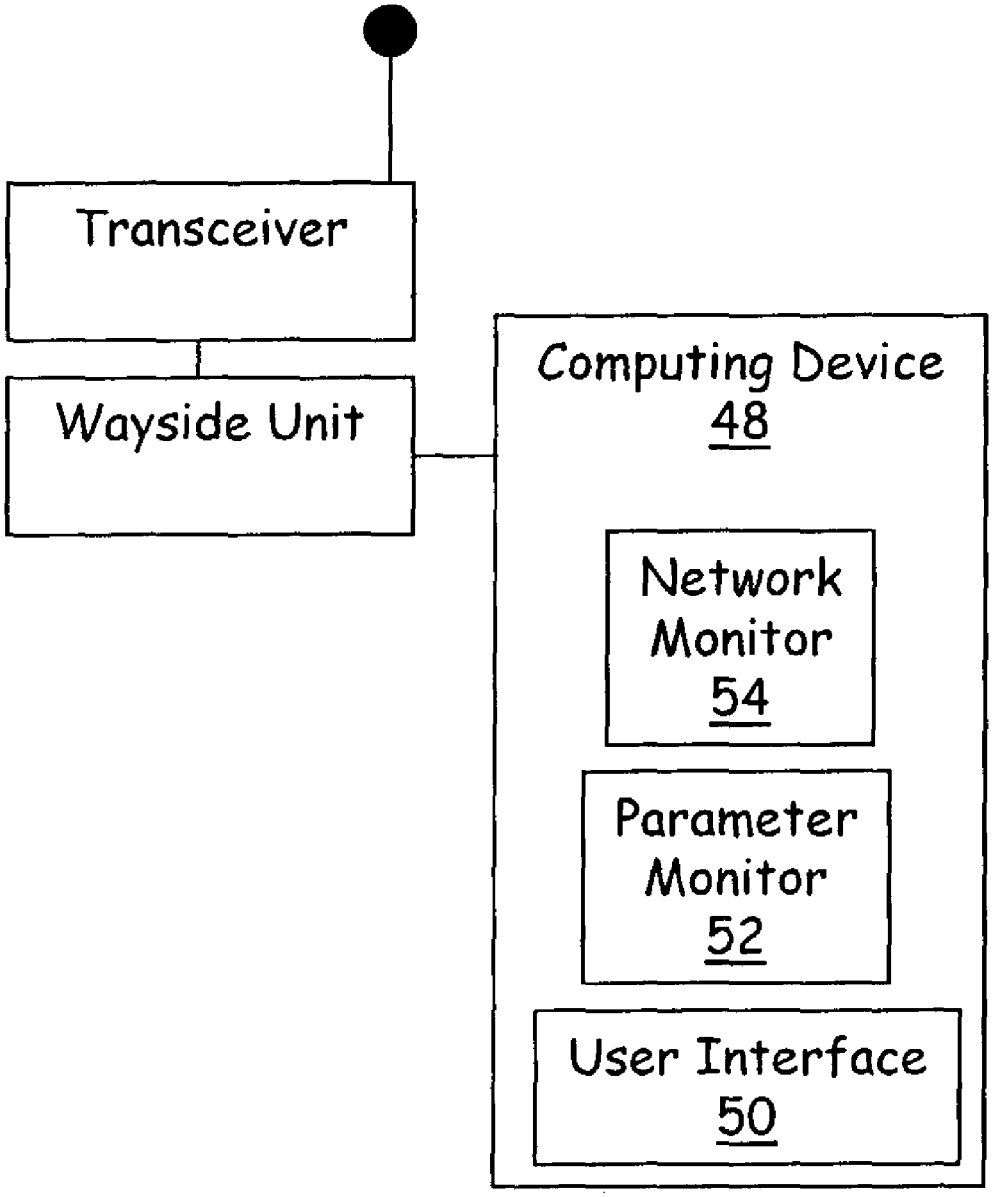
FIG. 4 is a schematic operational diagram of an exemplary monitoring device, as shown in FIG. 1.

FIG. 4 is a schematic operational diagram of an exemplary computing device, as shown in FIG. 1. The computing device 48 contains a user interface 50, a parameter monitor 52, and a network monitor 54. The computing device may be any standard computer, and may be implemented on such devices as mobile handheld computing units or the like.

In the user interface 50, the various surveillance posts and surveillance sensors may be selected and displayed by an operator. The individual parameters, combinatorial triggers, or threshold alarms may be accessible and/or altered from the user interface 50 of the computing device 48.

In one embodiment, clicking upon a specific sensor of a specific surveillance post brings a table of information to the user interface 50. Such information may contain environmental data at the site, environmental data of the surveillance sensor or the surveillance post, threshold levels for alarms, trigger settings, and dynamic allocation of multiple or single alarm levels. In this manner, an alarm may be classified and prioritized according to various levels, various combinations of levels, or various combinations of individual sensor readings coupled with the sensor readings from other surveillance sensor. The alarm states can be user definable.

The user interface 50 may represent the units according to status. In one embodiment, the units are color coded. In this embodiment, green equates to normal operation, yellow to one or more alarms, and red to the absence of signal from the particular sensor or spot. Of course, other schemes may be envisioned wherein the color scheme depicts the various levels of alarm. The interface may also employ blinking outputs to alert operators.

Implemented in conjunction with the user interface 50, a unit editor may be present. This allows the operator to remotely monitor and change the various settings associated with the surveillance post, the surveillance sensor, or any combination.

In a detail view, which can be obtained when clicking on the particular sensor, the various control and/or alarm signals can be displayed in a tabular format. The particular entries creating the alarm can be highlighted.

Further, in addition to sensor signals, the apparatus can track and diagnose internal problems. For example, the diagnostics of particular sensors may be displayed, and if the environmental conditions exceed a particular threshold, this may also cause an alarm to be displayed. As such, the various surveillance signals and/or operational signals may be monitored closely, and at any point in the system.

Additionally, the system may also store a history. In this manner, the events in the particular system and/or sensor may be preserved on an ongoing basis.

Thus, a system and method for transmitting and monitoring surveillance signals from multiple units to a number of points is described and illustrated. Those skilled in the art will recognize that many modifications and variations of the present invention are possible without departing from the invention. Of course, the various features depicted in each of the Figures and the accompanying text may be combined together. Accordingly, it should be clearly understood that the present invention is not intended to be limited by the particular features specifically described and illustrated in the drawings, but the concept of the present invention is to be measured by the scope of the appended claims. It should be understood that various changes, substitutions, and alterations could be made hereto without departing from the spirit and scope of the invention as described by the appended claims that follow.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A communication device for relaying data associated with a surveillance system, the communication device comprising:

a plurality of inputs for communicatively coupling the communication device with a plurality of surveillance sensors, each of the plurality of inputs associated with one of a plurality of surveillance sensor data streams including input surveillance sensor data streams directed to the plurality of surveillance sensors and output surveillance sensor data streams directed from the plurality of surveillance sensors;

a first wireless communication device for inputting an input data stream containing the input surveillance sensor data streams directed to the plurality of surveillance sensors, and for outputting an output data stream containing the output surveillance sensor data streams directed from the plurality of surveillance sensors, the output data stream directed to a second wireless communication device;

a communication junction, communicatively coupled to the first wireless communication device and the plurality of inputs, operable to coalesce the plurality of output surveillance sensor data streams into the output data stream; and the communication junction operable to retrieve an individual input surveillance sensor data stream from the input data stream, and direct the individual input surveillance sensor data stream to a particular one of the plurality of inputs, the second wireless communication device being associated with a second communication junction communicatively coupled to the second wireless communication device and a second plurality of inputs and being operable to coalesce a second plurality of output surveillance sensor data streams into a second output data stream, the second communication junction further being operable to retrieve a second individual input surveillance sensor data stream from a second input data stream, and direct the second individual input surveillance sensor data stream to a particular one of the second plurality of inputs.

2. The communication device of claim 1, the communication junctions each comprising a multiplexer, communicatively coupled to the plurality of inputs, that multiplexes the plurality of output surveillance sensor data streams into the output data stream.

3. The communication device of claim 2 wherein the multiplexer employs a time domain multiplexing algorithm.

4. The communication device of claim 1, the communication junctions each comprising a demultiplexer, communicatively coupled to the wireless communication device, that demultiplexes the input data stream into the plurality of input surveillance sensor data streams.

5. The communication device of claim 1 wherein the wireless communication devices and the communication junctions are coupled in a bidirectional manner.

6. The communication device of claim 1 wherein the communication between the communication junctions and the wireless communication devices is delivered on a subcarrier associated with the outputs of the first wireless communication devices to the second wireless communication device.

7. The communication device of claim 1 wherein a received data stream comprises control messages for a particular surveillance sensor.

8. The communication device of claim 1 wherein one of the plurality of inputs is associated with an acoustic message.

9. A communication device for relaying data associated with a surveillance system, the communication device comprising:

a plurality of inputs for communicatively coupling the communication device with a plurality of surveillance sensors, each of the plurality of inputs associated with one of a plurality of surveillance sensor data streams including input surveillance sensor data streams directed to the plurality of surveillance sensors and output surveillance sensor data streams directed from the plurality of surveillance sensors;

a first wireless communication device for inputting an input data stream containing the input surveillance sensor data streams directed to the plurality of surveillance data sensors, and for outputting an output data stream containing the output surveillance sensor data streams directed from the plurality of surveillance sensors, the output data stream directed to second wireless communication device;

a communication junction, communicatively coupled to the first wireless communication device and the plurality of inputs, operable to coalesce the plurality of output surveillance sensor data streams into the output data stream;

the communication junction operable to retrieve an individual input surveillance sensor data stream from the input data stream, and direct the individual input surveillance sensor data stream to a particular one of the plurality of inputs; and one of the plurality of inputs is associated with an acoustic message delivered to an operator, the second wireless communication device being associated with a second communication junction communicatively coupled to the second wireless communication device and a second plurality of inputs and being operable to coalesce a second plurality of output surveillance sensor data streams into a second output data stream, the second communication junction further being operable to retrieve a second individual input surveillance sensor data stream from a second input data stream, and direct the second individual input surveillance sensor data stream to a particular one of the second plurality of inputs.

* * * * *